US007441293B1

(12) United States Patent
Singer et al.

(10) Patent No.: US 7,441,293 B1
(45) **Date of Patent: *Oct. 28, 2008**

(54) SUPPORT FOR A LOWER SHOULDER AND EXTENDED ARMS OF A PERSON LYING ON THEIR SIDE

(75) Inventors: Adam Joel Singer, Bell Canyon, CA (US); Arthur Starr, Encino, CA (US)

(73) Assignee: Singer Starr Stacker, LLC, Encino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/899,941

(22) Filed: Sep. 10, 2007

(51) Int. Cl.
*A47C 17/86* (2006.01)
*A47C 20/00* (2006.01)

(52) U.S. Cl. ..... 5/646; 5/632

(58) Field of Classification Search ..... 5/632, 5/646, 657, 647
See application file for complete search history.

(56) References Cited

U.S. PATENT DOCUMENTS

| | | | | |
|---|---|---|---|---|
| 561,562 | A | 6/1896 | Brownson et al. | |
| 3,297,026 | A | 1/1967 | Van Pelt | |
| 3,535,718 | A | 10/1970 | Murcott | |
| 3,939,829 | A | 2/1976 | Spann | |
| 4,270,235 | A | 6/1981 | Gutmann | |
| 4,414,969 | A | 11/1983 | Heyman | |
| D321,562 | S | 11/1991 | Ljungvall | |
| 5,604,933 | A | 2/1997 | Stephens | |
| D382,057 | S | 8/1997 | Swedberg et al. | |
| D413,982 | S | 9/1999 | Swedberg et al. | |
| D415,281 | S | 10/1999 | Swedberg et al. | |
| D426,307 | S | 6/2000 | Swedberg et al. | |
| 6,490,742 | B2 * | 12/2002 | Hall et al. | 5/630 |
| 6,622,727 | B2 | 9/2003 | Perry | |
| 7,017,215 | B1 * | 3/2006 | Singer et al. | 5/646 |

OTHER PUBLICATIONS www.intensivetherapeutics.com.

* cited by examiner

*Primary Examiner*—Patricia Engle
*Assistant Examiner*—Jonathan J Liu

(57) ABSTRACT

One embodiment comprises a set of three stacked cushions to support a lower shoulder and both extended arms of a patient in a lateral and semi-lateral position on a bed. A bottom cushion has a flat compressible surface to support the patient's lower shoulder and a middle cushion. Smaller middle and top cushions stack on the bottom cushion. The middle and top cushions each comprises a top surface with a furrow for support and access to the arms. In addition, the middle and top cushions have cut-off corners that provide access to the person's nasopharyngeal cavities.

22 Claims, 3 Drawing Sheets

SUPPORT FOR A LOWER SHOULDER AND EXTENDED ARMS OF A PERSON LYING ON THEIR SIDE

CROSS-REFERENCE TO RELATED APPLICATIONS

This application is related to U.S. Pat. No. 7,017,215 to Singer, et al. (2006).

FEDERALLY SPONSORED RESEARCH

Not Applicable

SEQUENCE LISTING OR PROGRAM

Not Applicable

BACKGROUND

1. Field

The field is a patient support system, specifically supports for buttressing a lower shoulder and extended arms of a patient lying on their side on a bed.

2. Prior Art

A patient on a bed is often required to lie on their side (laterally) or semi-side (semi-lateral) positions. For example, the patient can be turned from side to side to prevent and heal pressure sores and ulcers that can occur on the patient's back. To effect and maintain these positions, each of the patient's wrists is commonly surrounded with a restraint such as a tie, cuff, strap, or other device that encircles each wrist and attaches to a side of the bed to restrain the patient. Although wrist restraints effectively hold the wrists and restrain the patient, they are uncomfortable and potentially harmful because they are not designed to support and buttress the many pressure points of the patient's shoulder that rests directly on the bed (lower shoulder) and their extended arms. For example, U.S. Pat. Nos. 4,414,969 to Heyman (1983), 5,604,933 to Stephens (1997), 3,297,026 to Van Pelt (1967), 3,535,718 to Murcott (1970), and 3,939,829 to Spann (1976), among others, show such wrist restraints, but fail to prevent such pressure points on the patient's shoulder.

Other unsatisfactory and potentially harmful practices to effect and maintain side and semi-side positions for patients in bed include the use of a pillow, towel, blanket, cushion, bolster, and other devices to prop up the patient's back off the bed; however, none of these are designed to support the shoulders and arms. For example, Intensive Therapeutics Inc. (www.intensivetherapeutics.com) manufactures cushions sold under the trademarks No-Slip Wegde and Bariatric No Slip-Wedge; these are designed to push up the person's back off the bed to hold their torso in lateral and semi-lateral positions, but these devices do not prevent pressure points on the shoulders and arms.

Other unsatisfactory and potentially harmful practices to effect and maintain side and semi-side positions for patients in bed include the use of a pillow, towel, blanket, cushion, bolster, and other devices to prop up the patient's chest, with or without a pillow, towel, blanket, cushion, bolster, and other devices to prop up the patient's back. However, none of these are designed to prevent pressure points on the patient's shoulders and arms and provide access to their nasopharyngeal cavities.

The prior art is replete with cushions having grooves or ridges that support one arm. U.S. Pat. No. 561,562 to Brownson, et al. (1896) describes a grooved armrest cushion that supports only one arm of telegraph operators, thereby preventing and alleviating paralysis of the arm. U.S. Pat. No. D321,562 to Ljungvall (1991) shows a grooved arm pillow that supports only one arm for measuring blood pressure. U.S. Pat. Nos. D382,057 (1997), D413,982 (1999), D415,281 (1999), and D426,307 (2000), all to Swedberg, et. al., show a grooved cushion hand support, a grooved arm positioning splint, a grooved arm with hand positioning splint, and a grooved arm splint with hand positioner, respectively, all being able to support only one arm. U.S. Pat. No. 4,270,235 to Gutmann (1981) describes an arm pillow with ridges on either side designed to support one arm in post-surgical convalescence patients reclining in the spine position. Although the ridges prevent the arm from rolling off the pillow in a manner similar to the operation of grooved cushions, the device is intended to support only one arm.

U.S. Pat. No. 6,622,727 to Perry (2003) describes cushions where a recessed wedge pillow and recessed arm cushions support a head, neck, and both arms. The device is designed to maintain the patient in a "sniffing angle" in the supine position on the operating table for endotracheal anesthesia.

U.S. Pat. No. 6,490,742 to Hall, et al. (2002) describes a plurality of stackable bolsters for purposes of elevating only one leg or one arm to a desired height.

Our own U.S. Pat. No. 7,017,215 (2006) discloses a pair of furrowed bottom and top cushions that stack to support both arms, but not the lower shoulder, of a patient lying on their side.

To review, all the devices and practices used to position a patient on their side heretofore known suffer from a number of disadvantages:

(a) Wrist restraints are uncomfortable and potentially harmful because they do not support and protect the many pressure points of the shoulders and extended arms of a person lying on their side in bed.

(b) Use of pillows, towels, blankets, cushions, bolsters, and other devices that push up against the patient's back to hold the patient on their side do not provide support for the shoulders and arms.

(c) Use of pillows, towels, blankets, cushions, bolsters, and other devices that push up against the patient's chest to hold the patient on their side provide haphazard support for the shoulders and arms. However, these devices tend to push the patient from their side onto their back and hinder access to the arms and nasopharyngeal cavities.

(d) Use of pillows, towels, blankets, cushions, bolsters, and other devices that press against the patient's back and chest to sandwich their body and maintain the patient on their side provide haphazard support the shoulders and the arms, but hinder access to the arms and nasopharyngeal cavities.

(e) Although our own U.S. Pat. No. 7,017,215 (2006) is the only device in common use designed to support and provide access to both arms for the patient lying on their side in bed, it does not prevent pressure points on the patient's lower shoulder.

SUMMARY

In accordance with one aspect, three stackable cushions provide support for the lower shoulder and extended arms for patients in lateral and semi-lateral positions on a bed. The bottom cushion comprises a flat compressible surface for supporting the patient's lower shoulder and the middle cushion. The middle and top cushions each comprise a top surface with a furrow for support and access to the arms. The middle and top cushions have cut-off corners that provide access to the nasopharyngeal cavities.

DRAWINGS

Figures

DRAWINGS

Reference Numerals

Figure 1:
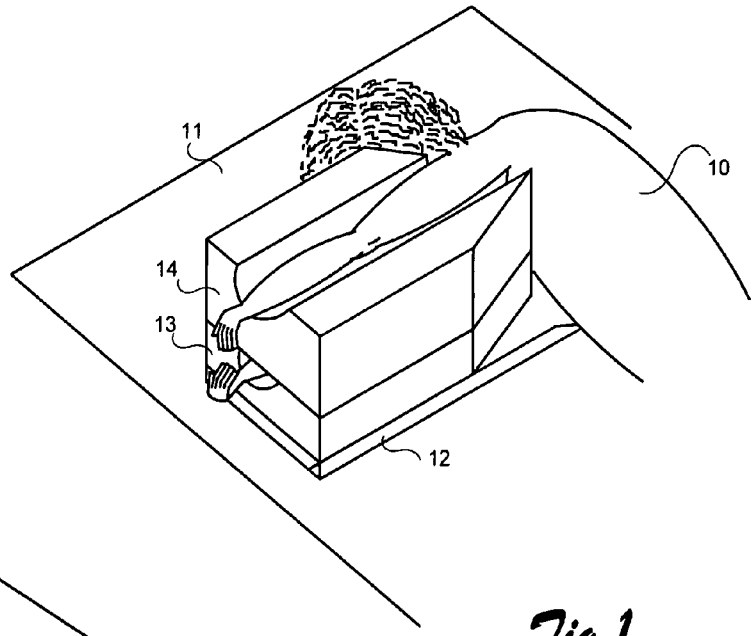
FIG. 1 is a perspective view a patient on a bed with both arms in a pair of stacked cushions resting on a bottom cushion accordance with one embodiment.

10 Patient
11 Bed
12 Bottom cushion
13 Middle cushion
14 Top cushion
15 Underside of bottom cushion
16 Top side of bottom cushion
17 Cephalic side of bottom cushion
18 Caudal side of bottom cushion
19 Inner end of bottom cushion
20 Outer end of bottom cushion
21 Underside of middle cushion
22 Top side of middle cushion
23 Cephalic side of middle cushion
24 Caudal side of middle cushion
25 Inner end of middle cushion
26 Outer end of middle cushion
27 Arm furrow of middle cushion
28 Inner cephalic cut-off corner of middle cushion
29 Inner caudal cut-off corner of middle cushion
30 Strips of hook-and-loop fasteners of middle cushion
31 Underside of top cushion
32 Top side of top cushion
33 Cephalic side of top cushion
34 Caudal side of top cushion
35 Inner end of top cushion
36 Outer end of top cushion
37 Arm furrow of top cushion
38 Inner cephalic cut-off corner of top cushion
39 Inner caudal cut-off corner of top cushion DETAILED DESRIPTION

FIGS. 1-6

Figure 2:
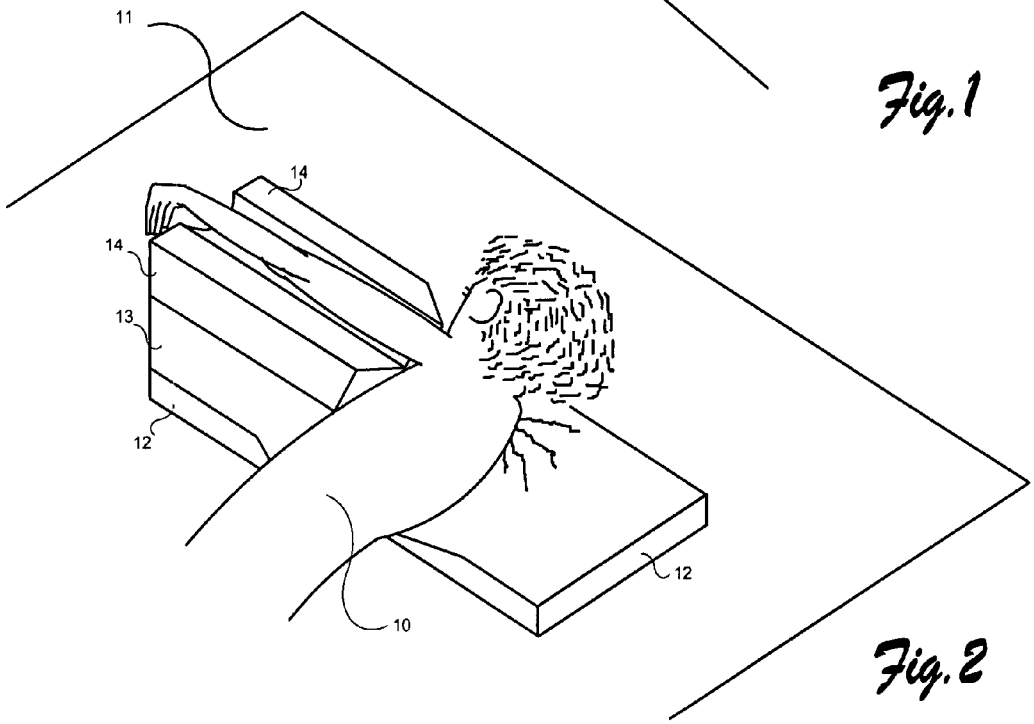
FIG. 2 is a perspective view the patient on the bed with both arms in the pair of stacked cushions resting on the bottom cushion of FIG. 1.

One embodiment of a set of stacked cushions for supporting a lower shoulder and arms of a patient lying on their side with their arms extended generally perpendicular to their body with one arm above the other is illustrated in FIGS. 1 and 2. A patient 10 is lying on their side on a conventional bed 11. A bottom cushion 12, a middle cushion 13, and a top cushion 14 are stacked on top of each other; bottom cushion 12 rests on bed 11. Cushions 12, 13, and 14 are constructed of high resilient foam rubber or other suitable viscoelastic cushioning with or without a soft fabric cover (removable or permanent) that may be manufactured through methods well known in the art.

Figure 3:
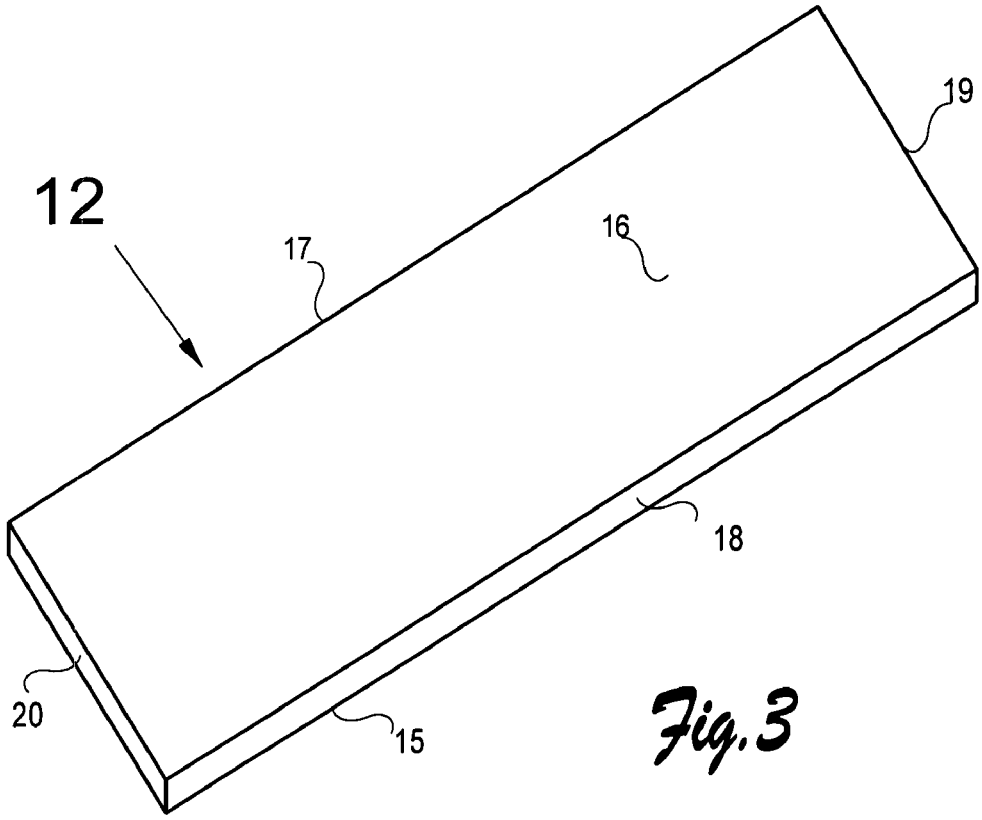
FIG. 3 is a perspective view of the bottom cushion of FIG. 1.

FIG. 3 shows bottom cushion 12, which comprises an underside 15, a top side 16, a cephalic (head) side 17, a caudal (tail or bottom) side 18, an inner end 19, and an outer end 20. Cushion 12 has an approximately rectangular shape with flat surfaces, has approximate overall dimensions of 25 cm (width)×90 cm (length)×4 cm (height), and has sufficient cross sectional area on top side 16 to support middle cushion 13 and the lower shoulder of patient 10 lying on their side on bed 11 (FIGS. 1 and 2). Underside 15 is placed directly on bed 11.

Figure 4:
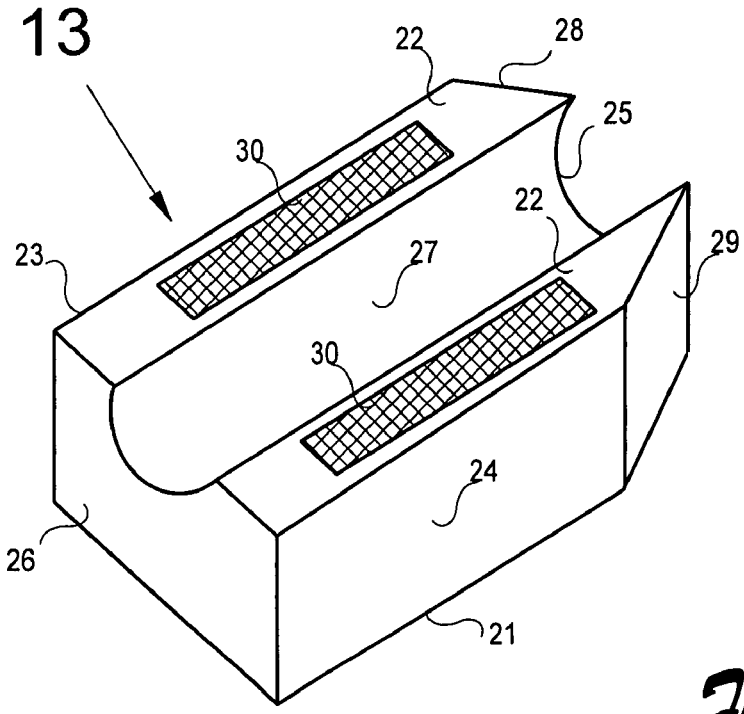
FIG. 4 is a perspective view of the middle cushion of FIG. 1.

FIG. 4 shows middle cushion 13, which comprises an underside 21, a top side 22, a cephalic side 23, a caudal side 24, an inner end 25 and an outer end 26. Middle cushion 13 has an approximately rectangular shape and has approximate overall dimensions of 25 cm (width)×38 cm (length)×12 cm (height) with an arm furrow, groove, trough, or cradle 27, an inner cephalic cut-off corner 28, and an inner caudal cut off corner 29. An arm furrow 27 extends from inner end 25 to outer end 26. Furrow 27 has sufficient cross-sectional area to support the patient's lower arm (FIG. 1) and allow the patient to insert it into furrow 27. Furrow 27 slopes upwardly from inner end 25 so that it is at approximately the same level of underside 21 of cushion 13 at inner end 25 and approximately 6 cm from underside 21 of cushion 13 at outer end 26. i.e., the thickness of cushion 13 measured from bottom 21 to the nadir of furrow 27 is zero at end 25 and 6 cm at end 26. Cut-off corners 28 and 29 of cushion 13 extend from top side 22 to underside 21 of cushion 13. Strips of hook-and-loop fasteners 30 extend along both of the non-furrowed regions of top side 22.

Figure 5:
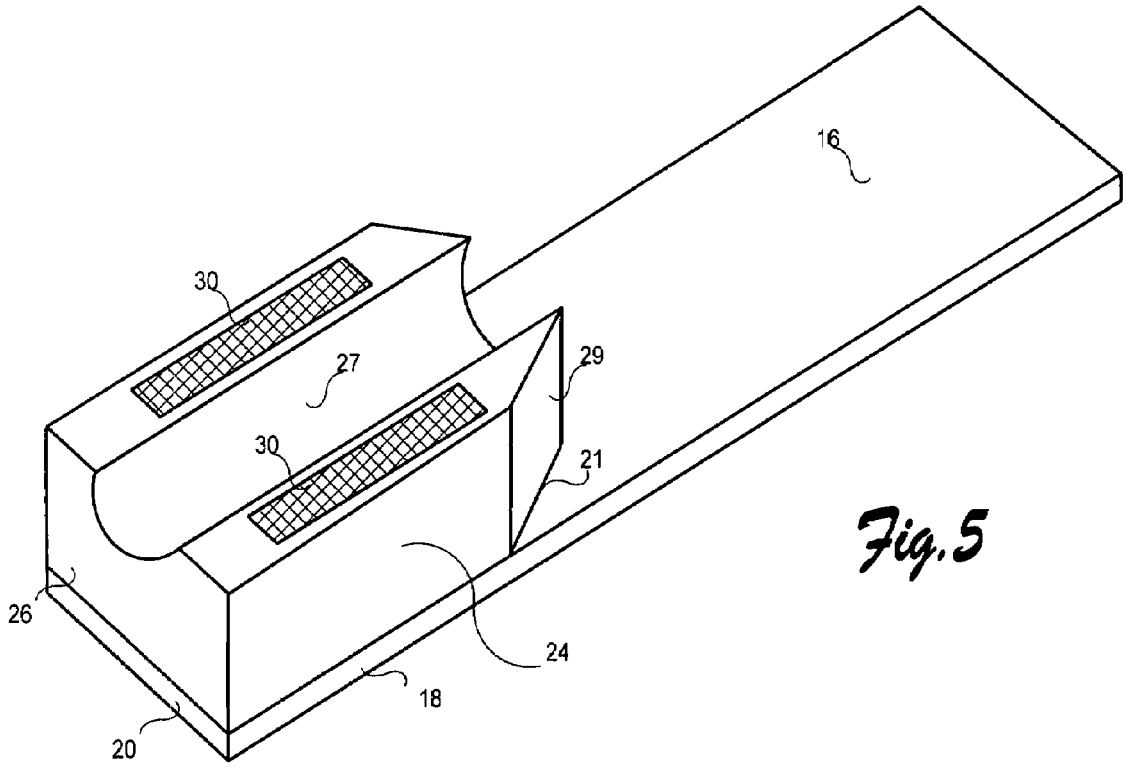
FIG. 5 is a perspective view of the middle cushion attached to the bottom cushion of FIG. 2.

As shown in FIG. 5, underside 21 of middle cushion 13 attaches directly to top side 16 of bottom cushion 12 by an adhesive so that outer end 20 of bottom cushion 12 and outer end 26 of middle cushion 13 are approximately coplanar. This configuration enables top side 16 of bottom cushion 12 to provide sufficient surface area to stabilize and support middle cushion 13, and conform around the patient's lower shoulder to support it and prevent pressure points when patient 10 is lying on their side on bed 11 (FIGS. 1 and 2).

Figure 6:
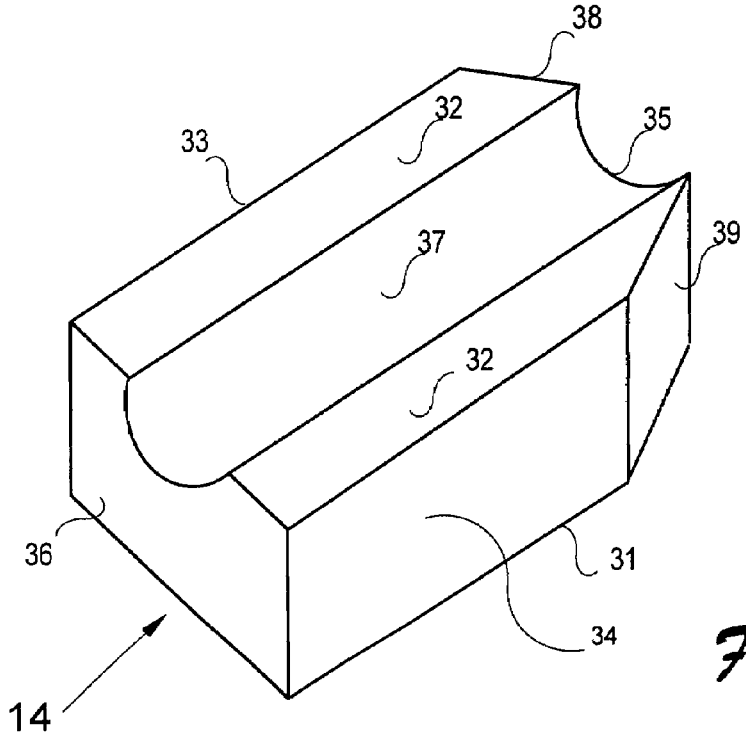
FIG. 6 is a perspective view of the top cushion of FIG. 1.

FIG. 6 shows top cushion 14, which consists of an underside 31, a top side 32, a cephalic side 33, a caudal side 34, an inner end 35, and an outer end 36. Top cushion 14 has an approximately rectangular shape, has approximate overall dimensions of 25 cm (width)×38 cm (length)×15 cm (height) with an arm furrow, groove, trough, or cradle 37, an inner cephalic cut off corner 38, and an inner caudal cut off corner 39. An arm furrow 37 extends from inner end 35 to outer end 36. Furrow 37 is approximately 5 cm deep and has sufficient cross-sectional area to support the patient's top arm (FIG. 1) and allow the patient insert it into furrow 37. The distance between the nadir of furrow 30 to underside 24 is approximately the distance between the inner aspects of the patient's arm pits and can be selected to match the size of the patient. For example, this distance can be 12 cm and 5 cm for large and small patients, respectively. Cut-off corners 38 and 39 of top cushion 14 extend from top side 32 to underside 31. Underside 31 of top cushion 14 stacks on top side 22 of middle cushion 13 so that cut-off corner 28 aligns with cut-off corner 38 and cut-off corner 29 aligns with cut-off corner 39 (FIG. 1). Two strips of hook-and-loop fasteners (not shown) on underside 31 are located like a mirror image to two strips of hook-and-loop fasteners 30 on top side 22 of middle cushion 13 when cushions 13 and 14 are stacked and aligned. These two sets of hook-and-loop fasteners come in direct contact so that they are sandwiched between middle cushion 13 and top cushion 14.

Operation—FIGS. 1-6

According to one embodiment, stackable cushions are used to support patient 10, awake or unconscious, in the lateral or semi-lateral position where the patient's lower shoulder rests on cushion 12, one arm rests in furrow 27 of middle cushion 13, and other arm rests in furrow 37 of cushion 14 as shown in FIGS. 1 and 2. Top cushion 14 adheres to middle cushion 13 by hook-and-loop strips. Middle cushion 13 adheres to bottom cushion 12 with adhesive. Bottom cushion 12 rests on bed 11. Cushions 12, 13, and 14 are constructed of high resilient foam rubber or other suitable viscoelastic cushioning that is soft and has compressible opposing surfaces. Cushion 12 is longer than cushions 13 and 14 and lies under the lower shoulder of patient 10 when lying on their side. The patient's body weight and lower shoulder against bottom cushion 12 resting on bed 11 causes their lower shoulder to compress bottom cushion 12 so that its cushioning surface conforms around their lower shoulder to provide safe and well-distributed support for it (FIG. 2). For example, disfigured, thin, and obese patients benefit greatly from bottom cushion 12 because it conforms to their different body configurations and sizes to meet their individual needs for support. In addition, stacked cushions 12, 13, and 14 do not fall over on their sides when patient 10 is lying on their side with each arm in their respective furrows because bottom cushion 12 is sandwiched between the patient's lower shoulder and bed 11, middle cushion 13 is attached adhesively and non-removably to bottom cushion 12, and upper cushion 14 is removably attached to middle cushion 13 by hook-and-loop fasteners.

The patient's lower arm rests in furrow 27 of middle cushion 13, and the upper arm rests in furrow 37 of top cushion 14 when patient 10 is lying on their side and their lower shoulder is supported by bottom cushion 12. Namely, the right and left arms are lower and upper, respectively, for the patient resting on their right side; the left and right arms are the lower and upper, respectively, for the patient resting on their left side; and the right and left shoulders are lower and upper, respectively, for the patient resting on their right side; the left and right shoulders are lower and upper, respectively, for the patient resting on their left side. Importantly, the lower shoulder and both arms are supported safely and padded optimally at all times during adjustable movements.

Furrow 27 of middle cushion 13 and furrow 37 of top cushion 14 have sufficient cross-sectional area to support, pad, and provide access to each arm when resting within their respective furrows and cushions 13 and 14 are stacked. Furrow 37 of top cushion 14 has no slope. Furrow 27 of middle cushion 13 has a slope of approximately 9 degrees that inclines gradually from inner end 25 to outer end 26 to prevent over extension of the patient's elbow of their lower arm (FIGS. 1 and 5).

Furrow 27 of middle cushion 13 can have a plurality of slopes to provide for the special requirements of the patient for support and comfort of the lower arm. For example, arthritic and disfigured patients with limited ability to straighten their lower elbow can be better supported by a furrow of middle cushion 13 having a greater slope while patients with limited ability to bend their lower elbow from a prior injury can be better supported by a furrow having a lesser slope or no slope. Furthermore, patients with a severely disfigured lower arm from a fracture, for example, can be better supported by a furrow of middle cushion 13 having more than one slope.

The shapes formed by aligning cut-off corners 28 to 38 and 29 to 39 provide access to the nasal and oral cavities for the purposes of feeding the patient, and placement, removal and maintenance of a multitude of medical devices, such as tubes and monitoring devices that are placed through the nasal and oral cavities. Cut-off corners 28, 29, 38, and 39 can be of various shapes and sizes to match the size and special requirements of the patient for access to their nasopharyngeal cavities. For example, patient's with facial fractures, burns, or trauma to the head or neck areas can benefit significantly from elliptical or oval shaped concave cut-off corners to provide greater access to the nasopharyngeal cavities.

Advantages

Accordingly, one or more embodiments of our stacked cushions may have one or more of the following advantages:

(a) Our stacked cushions enhance support, safety, stability, and padding for the lower shoulder and the extended arms for the patient in the lateral or semi-lateral position wherein both arms are placed one on top of the other on a bed;

(b) They provide one device for supporting the lower shoulder and the extended arms for the patient in the lateral or semi-lateral position;

(c) They reduce the incidence of bodily injury that may be caused by the use of ties, cuffs, straps, and other wrist restraints not specifically designed to support the lower shoulder and the extended arms for the patient in the lateral or semi-lateral position so that the highest degree of support, safety, stability, and padding is achieved;

(d) They enhance the support and access to the arms compared to the use of pillows, cushions, towels, blankets, bolsters, and other devices pushed against the patient's back when in the lateral or semi-lateral position;

(e) They provide improved access to the nasopharyngeal cavities and safer support to the arms compared to the use of pillows, cushions, towels, blankets, bolsters, and other devices pushed against the patient's chest when in the lateral or semi-lateral position;

(f) They reduce the incidence and promote the healing of pressure sores and ulcers on the patient's back when lying in the lateral or semi-lateral position;

CONCLUSIONS, RAMIFICATIONS, AND SCOPE

Accordingly the reader will see that at least one embodiment of the stacked cushions provide a more reliable, safer, lightweight, and economical device that support the lower shoulder and extended arms generally perpendicular to a patient's body when lying on their side on a bed. The furrows and cut off corners in the top and middle cushions provide unhindered access to the arms and the nasopharyngeal cavities, respectively. The bottom cushion has compressible opposing surfaces that conform around and support the patient's lower shoulder and provide a platform to support the middle cushion. The stacked cushions do not fall over on their sides when the patient is lying on their side with arms in their respective furrows because the bottom cushion is sandwiched between the patient's lower shoulder and the bed, the middle cushion is attached adhesively and non-removably to the bottom cushion, and the upper cushion is removably attached to the middle cushion by hook-and-loop fasteners. Our cushions are constructed of high resilient foam rubber or other suitable viscoelastic cushioning that prevents bodily injury caused by the combination of pillows, cushions, towels, blankets, bolsters, wrist restraints, and other devices not specifically designed to support the arms and lower shoulder. In addition, the cushions avoid the expense of using more than one device to support the lower shoulder and extended arms of a patient lying on their side.

Our stacked cushions can be used with and without wrist restraints attached to the bed. For example, wrist restraints can be used for uncooperative combative patients who need wrist restraints to prevent self-inflicted injuries. In addition, straps can be used to encircle the stacked cushions, with or without wrist restraints, to provide added restraint for patients lying on their side in bed. In lieu of three stacked cushions, one single-piece cushion with slots for arms can be used. All three cushions can be one integral member.

While the above description contains many specificities, these should not be construed as limitations on the scope of the invention, but as exemplifications of the embodiments thereof. Many other ramifications and variations are possible within the teachings of our invention. Modifications in a wide variety of ways to the precise dimensions, depth, shape, and cross-sectional area of the cushions, furrows, and cut off corners can be made and still fall within the spirit of our device. For example, the cushions, furrows, and cut off corners can be triangular, oval, square, rectagonal, and other regular or irregular shape, either level or not level to a horizontal or vertical plane of the bed, and provide support, security, comfort, and access to the lower shoulder and arms, and access to the nasopharyngeal cavities of the patient of various sizes, shapes, and disabilities when the patient is lying on their side.

Furthermore, pillows, cushions, towels, blankets, bolsters, and other cushioning devices can rest and movably adjust on the top side of the bottom cushion, attachable or non-attachable, so that they are contiguous to the patient's back to provide support to the patient. These padding devices can be adjusted to support the backs of various patients. For example, obese and thin patients need the back cushion further away and closer to the middle cushion, respectively, to properly support their backs. Alternatively, the dimensions of the bottom cushion can be modified to include a cushioning surface (back cushion) to support the patient's back. The precise dimensions, depth, shape, and cross-sectional area of the back cushion of the bottom cushion can be various sizes and shapes and still fall within the spirit of our device. For example, it can be triangular, oval, square, rectangular, and other regular or irregular shape, either level or not level to a horizontal or vertical plane of the bed, and provide support to the back when the patient is lying on their side.

In addition, the middle and top cushions do not have to align as described and may slide with respect to each other to maximize support and access to the shoulders and arms and provide unhindered access to the nasal and pharyngeal cavities for the patient of various sizes, shapes, and disabilities.

Furthermore, the cushions may be stacked or not stacked, together or separately, and in a plurality of orientations to provide access and support to the arms and legs. The cushions may be disposable or reusable, not covered or covered with a soft fabric material, and attached to each other by hook-and-loop fasteners, by hinges, adhesives, and other holding devices that allow the cushions to be attached together temporarily or permanently and still fall within the scope of the device. In addition, a flat lid for resting devices such as surgical scissors, forceps, and needle holders may be attached by either hook-and-loop fasteners or by hinges to any side or end of the top or middle cushions when these cushions are stacked or not stacked, respectively.

Use of our cushions is not limited to use for the arms and lower shoulder; it can also be used to support the legs. In addition, our cushions can be placed on various types of patient supports, such as hospital beds, massage, chiropractic, or acupuncture tables, where a user can lie in the lateral or semi-lateral positions with their arms extended generally perpendicular to their torso. Therefore, the term "bed" as used in the description of our device should be understood to mean any type of patient support, such as a surgical table, treatment table, chair, stretcher, or back board. For example, our cushions may be used to support the arms for rescue and transport of an injured patient who is best suited for travel on their side to prevent further bodily harm.

Our cushions are can be used by persons who are not patients. For example, many persons in lateral or semi-lateral positions will find the cushions comfortable for activities such as sleeping or watching television. The cut-off corners facilitate a person's ability to see beyond the inner and outer ends of the stacked cushions to enable participation in activities such as conversation, watching television, reading a book, and resting on their side. Therefore, the term "patient" as used in the description of our device should be understood to mean any type of person.

Furthermore, our cushions can be used to support one or both extremities and a lower shoulder of a non-human animal as can be used by those skilled in the art of veterinary medicine.

Thus the scope should be determined by the appended claims and their legal equivalents, and not by the examples given.

We claim:

1. A support for the arms and lower shoulder of a person lying on their side, where said person, when so lying, has upper and lower shoulders, and upper and lower arms that extend parallel in a direction generally perpendicular to said person's torso and have a predetermined spacing, comprising:

a resilient member comprising stacked upper, middle, and bottom elongated cushions, said upper cushion being arranged to support said upper extended arm, said middle cushion being arranged to support said lower extended arm, and said bottom cushion being larger than said middle and upper cushions so as to be able to support said stacked middle and upper cushions and said lower shoulder, each cushion having an upper surface, each cushion having a generally rectangular shape and sized to be positioned on top of a bed;

said upper and middle cushions having a predetermined thickness for supporting said extended arms and said predetermined spacing of said extended arms, said upper and middle cushions each having a longitudinal arm furrow which extends along the length of said upward surface of each cushion so as to divide said upper surface into two spaced flat portions separated by said furrow, said furrow extending from one planar face to an opposite planar face, and having a constant width along the length of the cushion;

said arm furrow of said upper cushion having a constant depth;

said bottom cushion having a predetermined thickness for supporting said lower shoulder, said bottom cushion comprising an elongated member having flat compressible opposing surfaces, whereby said resilient member provides comfortable support and access to said arms and lower shoulder, assists in treatment and prevention of sores on the back, and facilitates access to the nasopharyngeal cavities of said person.

2. The support of claim 1 wherein said stackable cushions comprise a lightweight viscoelastic foam material.

3. The support of claim 1, further including a pair of mating hook-and-loop fasteners for removably attaching said upper and middle stacked cushions together.

4. The support of claim 1 wherein said middle and bottom stacked cushions are adhesively and non-removably attached together.

5. The support of claim 1 wherein each longitudinal furrow has predetermined dimensions for facilitating access to said arms for placement, removal, and maintenance of a plurality of medical devices.

6. The support of claim 1 wherein each longitudinal furrow has predetermined dimensions for said arms, whereby said person can moveably adjust safely within each said rest or cradle during repositioning of said person, arms, shoulders, cushions or bed.

7. The support of claim 1 wherein said stacked upper and middle cushions each has cut-off corners having predetermined dimensions nearest said person's body for facilitating access to said person's nasopharyngeal cavities for placement, removal, and maintenance of said plurality of medical devices, said cut-off corners of said stacked upper and middle cushions being contiguous.

8. The support of claim 1 wherein said bottom cushion has predetermined dimensions for supporting said middle cushion and said lower shoulder of a person having a predetermined size.

9. The support of claim 1 wherein said bottom cushion has predetermined cushioning properties for shaping around and supporting said lower shoulder of said person.

10. The support of claim 1 wherein said stacked bottom cushion for said lower shoulder has a flat compressible surface and said longitudinal arm furrow of said stacked middle cushion for said lower arm has a sloping surface, whereby said person can lay on their side for the treatment and prevention of pressure sores of said person's back.

11. The support of claim 1 wherein said longitudinal arm furrow of said upper cushion for said upper arm has a non-sloping surface, whereby said person can lay on their side for the treatment and prevention of pressure sores of said person's back.

12. The support of claim 1 wherein said support is selected from the class consisting of disposable and reusable supports.

13. A support for the arms and lower shoulder of a person lying on their side, where said person has upper and lower shoulders and said upper and lower arms that extend parallel and away from said person's body and have a predetermined spacing, comprising:

a resilient member comprising an upper, middle, and bottom generally rectangular cushion, said upper cushion oriented to support said upper extended arm, said middle cushion oriented to support said lower extended arm, and said bottom cushion being larger than said middle and upper cushions so as to be able to support said middle and upper cushions and said lower shoulder, each cushion having an upper surface and sized to be stacked sequentially on top of a bed;

said upper and middle cushions each having a longitudinal arm slot which extends along the length of said upward surface of each cushion so as to divide said upper surface into two spaced flat portions separated by said slot, said slot extending from one planar face to an opposite planar face, and having a constant width along the length of the cushion;

said arm slot of said upper cushion having a constant depth;

said bottom cushion comprising an elongated member having flat squeezable opposing surfaces, whereby said resilient member provides comfortable support and access to said arms, support for said lower shoulder, facilitates treatment and prevention of ulcers on said person's back, and provides access to the nasopharyngeal cavities of said person.

14. The support of claim 13 wherein said stackable cushions comprise lightweight viscoelastic foam material and selected from the class consisting of disposable and reusable supports.

15. The support of claim 13, further including a pair of mating hook-and-loop fasteners for removably attaching said upper and middle stacked cushions together.

16. The support of claim 13 wherein said stacked middle and bottom cushions are non-removably attached together.

17. The support of claim 13 wherein said arm slots have predetermined dimensions for facilitating access to said arms for placement, removal, and maintenance of a plurality of medical devices.

18. The support of claim 13 wherein each said arm slot has predetermined dimensions for said arms, whereby said person can moveably adjust safely within each said slot during repositioning of said person, arms, shoulders, cushions or bed.

19. The support of claim 13 wherein said stacked upper and middle cushions each has cut-off corners having predetermined dimensions nearest said person's body for facilitating access to said person's nasopharyngeal cavities for placement, removal, and maintenance of said plurality of medical devices, said cut-off corners of said stacked upper and middle cushions being contiguous.

20. The support of claim 13 wherein said bottom cushion has predetermined cushioning properties for shaping around and supporting said lower shoulder of said person for supporting said lower shoulder of said person.

21. The support of claim 13 wherein said stacked bottom cushion for said lower shoulder has flat squeeezable opposing surfaces and said longitudinal arm slot of said stacked middle cushion for said lower arm has a sloping surface, whereby said person can lay on their side for the treatment and prevention of pressure sores of said person's back.

22. The support of claim 13 wherein said longitudinal arm slot of said upper cushion for said upper arm has a level surface without a slope, whereby said person can lay on their side for the treatment and prevention of pressure sores of said person's back.

* * * * *